US006452344B1

(12) United States Patent
MacAdam et al.

(10) Patent No.: US 6,452,344 B1
(45) Date of Patent: Sep. 17, 2002

(54) ELECTRONIC DIMMING BALLAST

(75) Inventors: Russell L. MacAdam, Coopersburg; Mark S. Taipale, Harleysville, both of PA (US); Oliver K. Mihm, Raleigh, NC (US); David G. Luchaco, Fogelsville, PA (US); Jason C. Killo, Emmaus, PA (US); Kolawole A. Otitoju, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 09/249,563

(22) Filed: Feb. 12, 1999

Related U.S. Application Data

(60) Provisional application No. 60/074,702, filed on Feb. 13, 1998.

(51) Int. Cl.[7] ..... G05F 1/00

(52) U.S. Cl. ..... 315/307; 315/291; 315/DIG. 4; 315/224

(58) Field of Search ..... 315/DIG. 4, 307, 315/291, 297, 209 SC, 209 R, 224, 225

(56) References Cited

U.S. PATENT DOCUMENTS

| | | | | |
|---|---|---|---|---|
| 4,651,060 A | | 3/1987 | Clark | 315/199 |
| 4,700,111 A | | 10/1987 | Folwell et al. | 315/200 |
| 5,063,490 A | * | 11/1991 | Maehara et al. | 363/37 |
| 5,182,503 A | * | 1/1993 | Denneman et al. | 315/224 |
| 5,363,020 A | * | 11/1994 | Chen et al. | 315/209 R |
| 5,396,155 A | | 3/1995 | Bezdon et al. | 315/291 |
| 5,493,182 A | * | 2/1996 | Sowa et al. | 315/291 |
| 5,539,281 A | | 7/1996 | Shackle et al. | 315/224 |
| 5,559,395 A | | 9/1996 | Venkitasurbrahmanian et al. | 315/247 |
| 5,583,402 A | | 12/1996 | Moisin et al. | 315/307 |
| 5,933,340 A | * | 8/1999 | Adamson | 363/97 |
| 5,998,937 A | * | 12/1999 | Nishigaki | |
| 6,040,661 A | * | 3/2000 | Bogdan | 315/224 |

FOREIGN PATENT DOCUMENTS

| | | |
|---|---|---|
| DE | 8915386 U | 6/1991 |
| EP | 0 435 228 | 12/1990 |
| WO | WO 93/25952 | 12/1993 |

* cited by examiner

*Primary Examiner*—Don Wong
*Assistant Examiner*—Tuyet T. Vo
(74) *Attorney, Agent, or Firm*—Drinker Biddle & Reath LLP

(57) ABSTRACT

An electronic dimming ballast has a parallel loaded resonant output circuit plus a combination of pulse width modulation and frequency variation to accomplish the dimming of compact fluorescent lamps. The ballast operates at a fixed frequency throughout a selected range of light levels, with dimming control being done completely by duty cycle variation over this range of operation, and then smoothly moves to a variable frequency as the light output moves outside the selected range, with both duty cycle and frequency variation being the means of lamp light output control outside the selected range.

31 Claims, 11 Drawing Sheets

ELECTRONIC DIMMING BALLAST

This application claims the benefit of provisional application No. 60/074,702, filed Feb. 13, 1998.

BACKGROUND OF THE INVENTION

Dimming fluorescent lamps requires a minimum amount of output impedance to assure stable lamp operation at low light levels. It is known to provide this by using a resonant circuit in the output of the inverter, and modulating the duty cycle of the inverter waveform to regulate the light output of the lamp. This works well for linear fluorescent lamps, which have a relatively small value of negative incremental impedance and therefore a moderate increase in lamp impedance when their light output is reduced from full to low levels. In this context, lamp impedance is defined as the ratio of lamp arc voltage to arc current, while incremental impedance is the change ill arc voltage that results from a small change in arc current at a particular arc current. The presence of negative incremental impedance is characteristic of all fluorescent lamps, such that an increase in arc current causes a resulting decrease in arc voltage.

Compact fluorescent lamps, however, have a much greater negative incremental impedance characteristic and a much larger increase in lamp impedance as they are dimmed, so they require a correspondingly larger impedance from the resonant circuit to operate properly at low light levels. Therefore, when parallel-loaded resonant circuit components are sized for proper operation of compact lamps at low light levels, the lamp impedance at full light output is low enough that the circuit is so heavily damped as to no longer exhibit resonance effects. In essence, the resonant circuit then acts like a simple series choke ballast at full light output. This is not detrimental to the operation of the lamp, but it does provide an additional restriction that must be accounted for in the selection of the values used in the resonant circuit components. The inductor value can no longer be freely chosen, but must be designed to allow the proper full light output current to flow when the inverter is operating at its maximum output point, which corresponds to a duty cycle of 50%. With the inductor value fixed by the full output current requirements, the capacitor value is then also determined by the operating frequency, so that the resonant circuit impedance is fixed as well. However, it has been found that this impedance is not sufficient to allow stable operation of compact fluorescent lamps at low light levels in a ballast where only the duty cycle is varied to provide dimming control. In such a system, if one chooses resonant circuit values that operate the lamp properly at low end light levels, the ballast will be unable to deliver the current needed to allow the lamp to achieve full light output, and if the values are sized to allow full light output to be reached, the output impedance of the resonant circuit is insufficient to allow stable operation of the lamp at low light levels.

It is well known in the art to control the light output level of fluorescent lamps by changing the frequency of ballast operation, rather than the duty cycle. This can be done with either resonant or non-resonant ballast output circuitry, but it is most commonly achieved with resonant techniques. In one variation of this approach, the ballast has a series-loaded resonant output circuit which operates slightly above resonance when the lamp is at full light output and far above resonance when the lamp is at minimum light output. To dim the lamp, the frequency is shifted up above resonance and the series resonant circuit then acts much more like an inductor. This scheme is not suitable for compact fluorescent lamps or high performance dimming, because the lack of resonance at low light levels means that the output impedance is insufficient to allow stable lamp operation. It also can be problematic with regard to electromagnetic interference (EMI), since the wide variation of frequency needed to accomplish the dimming in this manner makes it difficult design a suitable EMI filter.

The use of parallel-loaded output circuits is also known in the ballast art. The assignee of the present application sells a fluorescent lamp ballast that incorporates a fixed frequency, variable duty cycle design, and another fluorescent lamp ballast that incorporates a variable frequency, fixed duty cycle design. Energy Savings Inc. of Schaumburg, Ill. and Advance Transformer of Chicago Ill. both have a fixed duty cycle, variable frequency fluorescent lamp ballast on the market. However, neither of these schemes is suitable for dimming compact fluorescent lamps. The fixed frequency, variable duty cycle design sold by the assignee of the present application has the problems detailed above, while the ESI ballast and the Advance Transformer ballast scheme suffer from the EMI difficulties inherent in any scheme that depends purely on frequency variation for dimming control.

SUMMARY OF THE INVENTION

The invention of the present application uses a parallel loaded resonant output circuit plus a combination of pulse width modulation and frequency variation to accomplish the dimming of compact fluorescent lamps. The invention implements a combination of variable duty cycle and variable frequency control, whereby the ballast operates at a fixed frequency throughout a selected range of light levels, with dimming control being done completely by duty cycle variation over this range of operation, and then smoothly moves to a variable frequency as the light output moves outside the selected range, with both duty cycle and frequency variation being the means of lamp light output control outside the selected range. Thus, for example, at high light levels, which are the most critical from the standpoint of EMI exposure, the ballast is essentially a fixed frequency unit and it is therefore relatively straightforward to design suitable EMI filtering as a result. As the lamp begins to approach the low light levels where output impedance becomes critical, the frequency is then shifted higher (towards resonance) and the required output impedance is thereby achieved. The additional degree of design freedom which the variation of frequency introduces allows the ballast designer to satisfy both the full lamp current criteria as well as the need for a proper output impedance at low light levels. One additional advantage of this technique is that the operation of the inverter switching devices can be maintained in the zero-voltage switching mode throughout the entire dimming range. With only duty cycle modulation, the switching devices do not operate in zero voltage switching mode at low light levels, which results in increased switching energy losses and additional heat and switching stress in the devices themselves.

In one embodiment, the invention encompasses an electronic dimming ballast for fluorescent lamps, arranged in use to supply to a fluorescent lamp an arc current from at least one controllably conductive device having a duty cycle and frequency of operation, the duty cycle and frequency of operation of the at least one controllably conductive device being independently controllable to adjust the light output of the lamp over a range of light outputs of the lamp from minimum to maximum.

The invention also encompasses an electronic dimming ballast for fluorescent lamps, comprising a circuit comprising at least one controllably conductive device for supplying a selected arc current to a fluorescent lamp to achieve a desired light output level from the lamp, a first circuit responsive to a dimming signal containing information representative of the desired light output level and generating an ac oscillator signal having a frequency determined by the dimming signal, and a second circuit responsive to the dimming signal for creating a duty cycle of operation for the at least one controllably conductive device at the frequency of the ac oscillator signal, the duty cycle being determined by the dimming signal, whereby the frequency and the duty cycle of operation of the at least one controllably conductive device are independently determinable over a range of desired light output levels of the lamp.

The invention also encompasses an electronic dimming ballast for fluorescent lamps, comprising an inverter circuit comprising at least one controllably conductive device for supplying a selected arc current to a fluorescent lamp to achieve a desired light output level from the lamp ranging from a minimum light output to a maximum light output, a first circuit for receiving a dimming signal containing information representative of a desired light level and generating a control signal representative of the desired light level, a second circuit responsive to the control signal for generating an ac oscillator signal having a frequency determined by the control signal, and a third circuit responsive to the control signal for creating a duty cycle of operation for the at least one controllably conductive device at the frequency of the ac oscillator signal, the duty cycle being determined by the control signal, whereby the frequency and the duty cycle of operation of the at least one controllably conductive device are independently determinable over the range of desired light levels from the minimum light output up to the maximum light output.

The invention also encompasses a method of selectably controlling the light output of a fluorescent lamp using an inverter circuit having at least one controllably conductive device for supplying a selected arc current to the fluorescent lamp to achieve a desired light output from the fluorescent lamp ranging from a minimum light output to a maximum light output, comprising the steps of generating a dimming signal variable from a state corresponding to a minimum light output of the lamp to a state corresponding to a maximum light output of the lamp, generating a control signal representative of the dimming signal, generating an ac oscillator signal having a frequency determined by the control signal, and generating a duty cycle of operation for the at least one controllably conductive device at the frequency of the ac oscillator signal, the duty cycle being determined by the control signal, whereby the frequency and the duty cycle of operation of the at least one controllably conductive device are independently determinable over the range of dimming signals variable from the state corresponding to the minimum light output up to the maximum light output.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
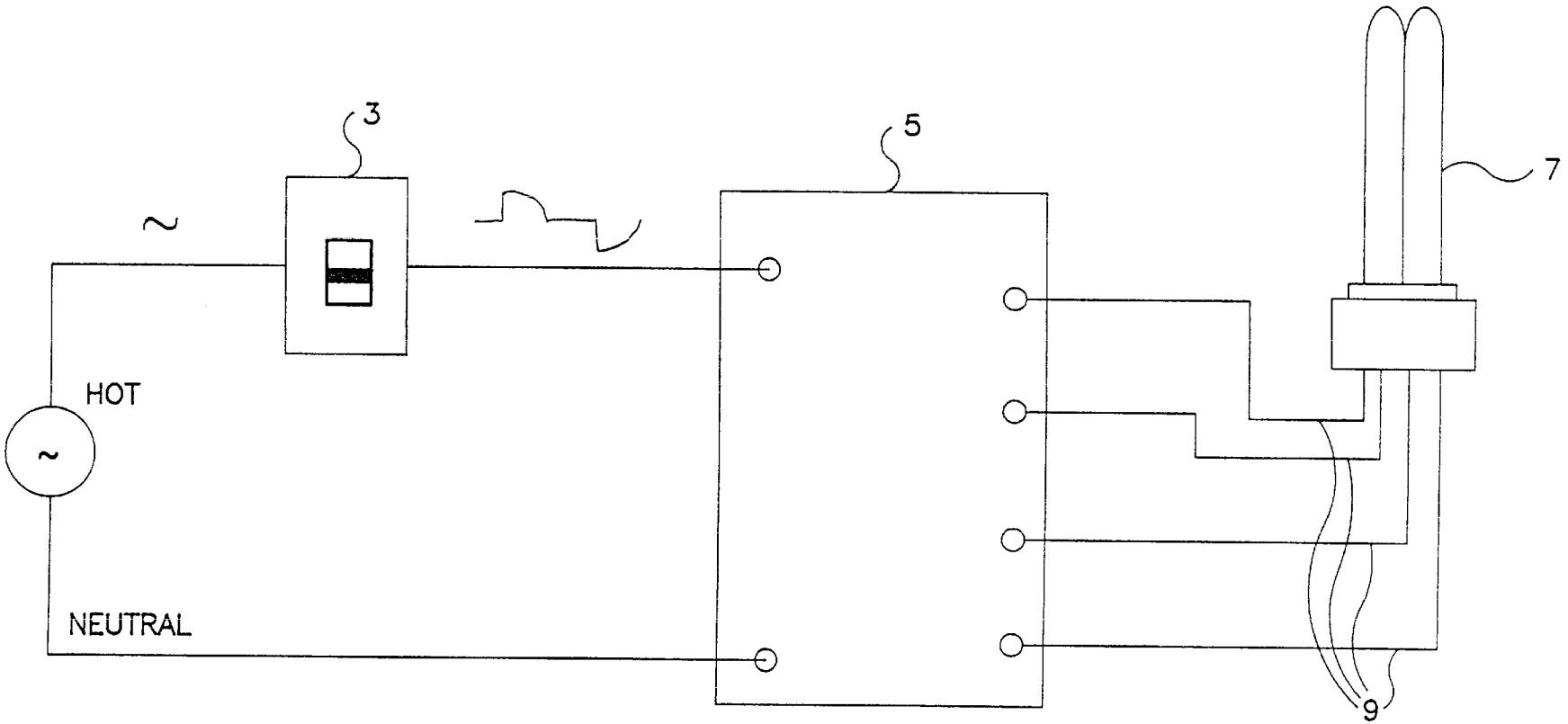
FIG. 1 is a simplified block diagram of a ballast according to the present invention connected in circuit with a lamp and a dimming control.

FIG. 1 shows a compact fluorescent lamp ballast 5 connected to a lamp 7 through wires 9. In the preferred embodiment, the ballast 5 is connected in series with the AC source 1 and a phase controlled wall-box dimminer 3. However, any type of signal can be used to control the operation of the ballast.

Figure 2A:
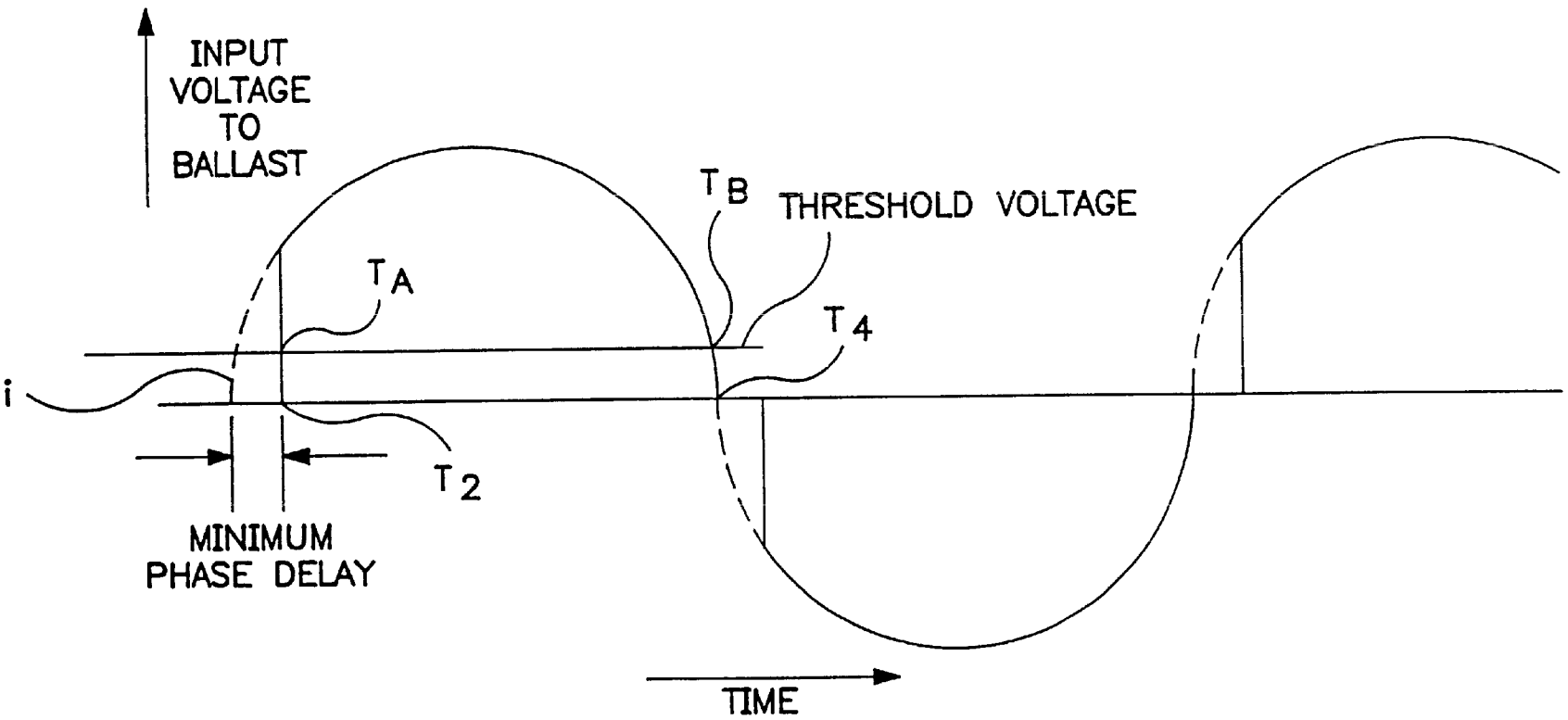
FIGS. 2*a* and 2*b* show the signal waveforms into the ballast for maximum and minimum lamp light output, respectively.

FIG. 2*a* shows the input voltage/signal into the ballast 5 of FIG. 1 when the dimmer 3 is set at high end, maximum light output. A period of time after each zero cross, the controllably conductive device, in dimmier 3 typically a triac or two anti-parallel SCRs for example, turns on. This is shown as point $T_2$. The voltage rapidly rises to the instantaneous line voltage of source 1 aid tracks the line voltage of source 1 until the next zero cross. The input voltage/signal into the ballast passes through a threshold voltage, preferably 60V, at points $T_A$ and $T_R$. These points are used by a Phase to DC Converter to establish the desired light level (see below). Point $T_B$ is chosen instead of the next zero cross to avoid noise generated around the zero cross.

Figure 2B:
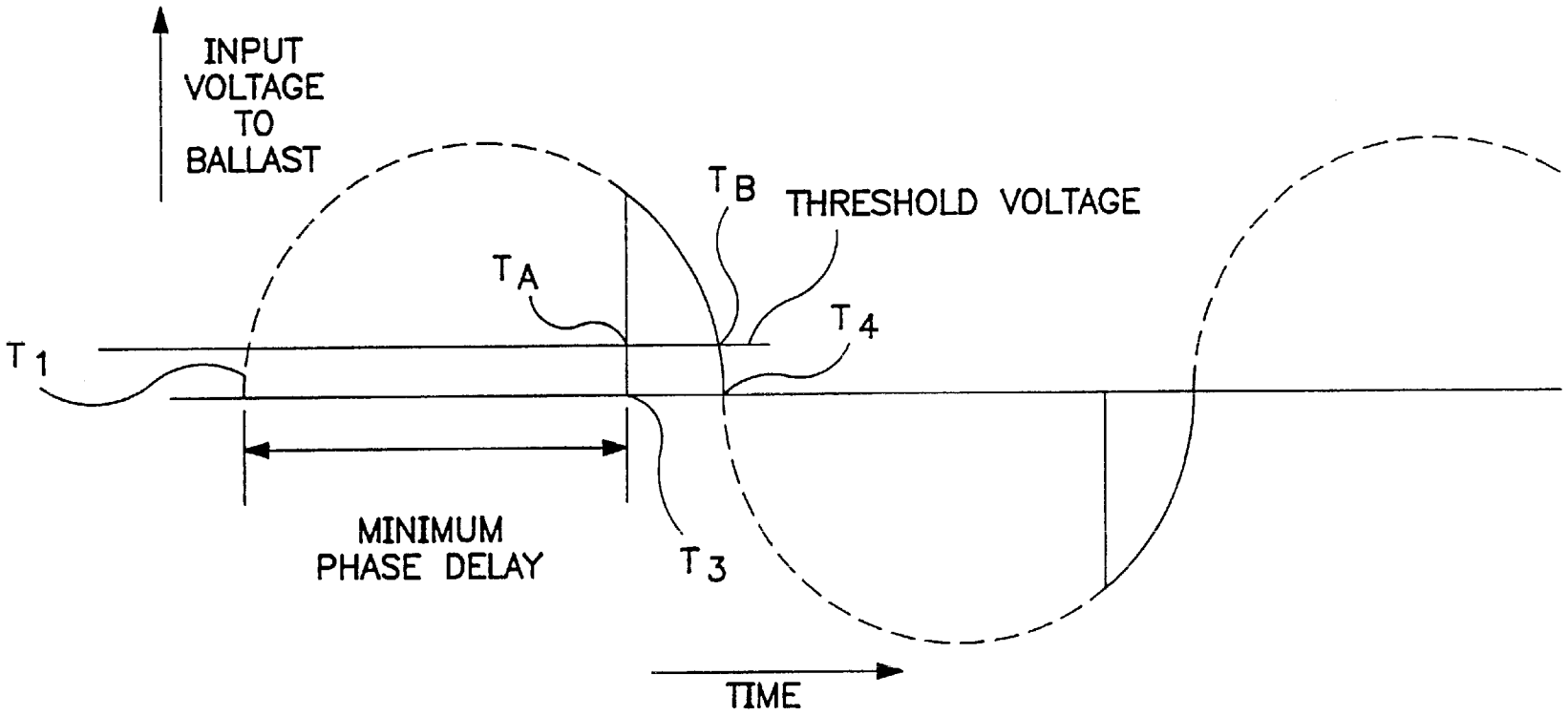

FIG. 2*b* shows the input voltage/signal into the ballast 5 of FIG. 1 when the dimmer 3 is set at low end, minimum light output. The controllably conductive device (preferably a triac) turns on at a point $T_3$. The turning on of the triac in the dimmer 3 can occur anywhere between the two extreme points $T_2$ and $T_3$ to achieve full range dimming.

Figure 3:
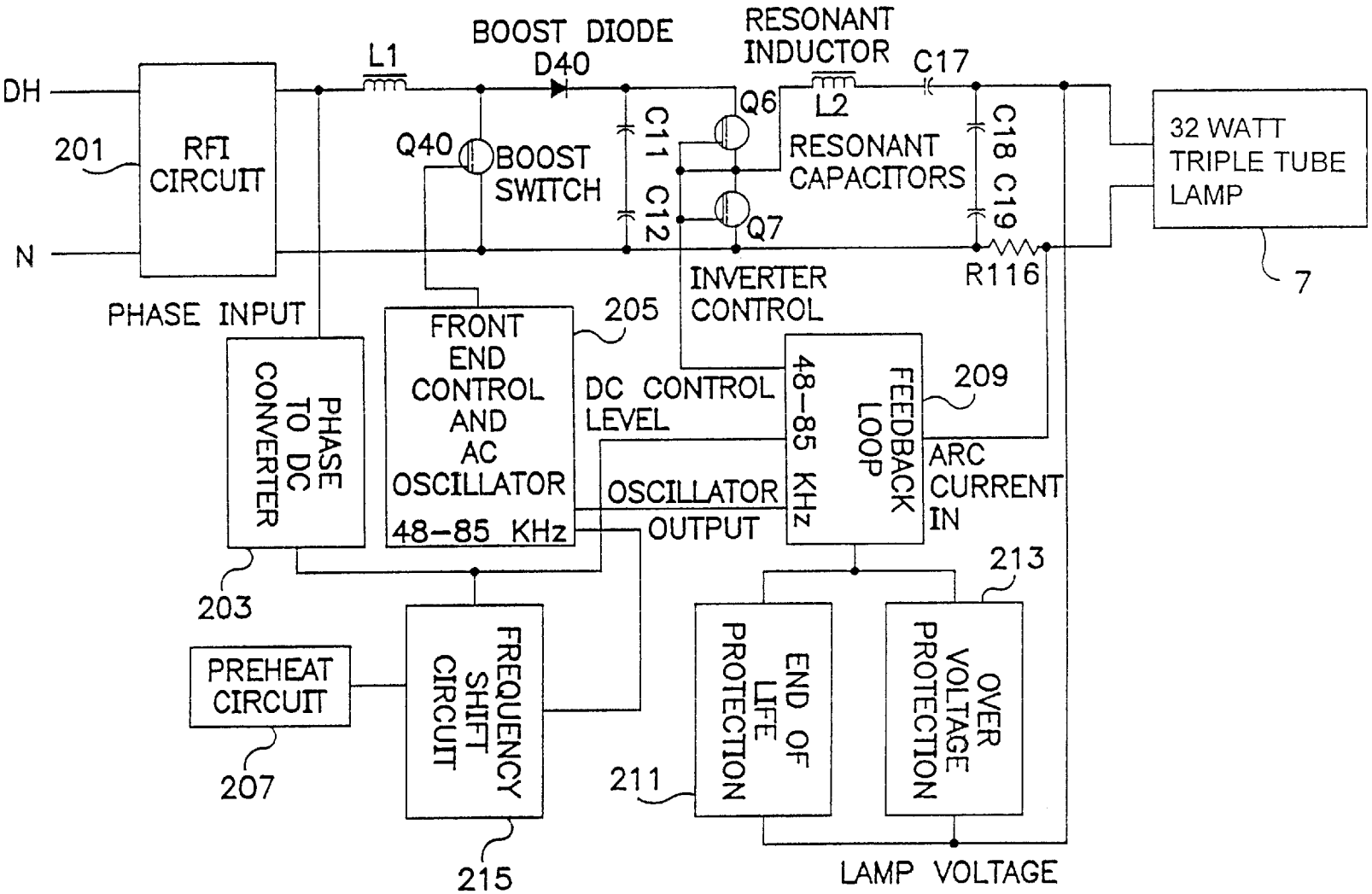
FIG. 3 is a simplified block diagram of a ballast according to the present invention.

FIG. 3 shows a block diagram of the ballast of the present invention connected to a lamp 7.

The RFI Circuit 201 provides the suppression of common mode and differential mode conducted emissions, in conventional manner.

The Phase to DC Converter Circuit 203 circuit takes the input voltage/signal into the ballast, which is a standard phase control voltage, and compares it with the threshold voltage to get a zero to five volt duty cycle modulated signal. This signal is then filtered to get a dc voltage, proportional to the phase control input, that is the control reference signal for the feedback loop. This dc voltage varies preferably between 0.7V and 2.2V and is the dc control level.

The Front End Control Circuit 205 is the control circuit for a standard boost converter, shown as the boost inductor L1, boost diode D40, and boost switch Q40. The boost control circuit modulates the switching in Q40 to keep the bus voltage across C11 and C12 at 460V dc. This circuit also contains the oscillator that is used in the entire ballast.

Before a fluorescent lamp can be struck, the cathodes need to be heated for about a half second. The Preheat circuit 207 modifies the Frequency Shift Circuit 215 to raise the oscillator frequency to 105 kHz. This causes the operating frequency to be such that there is enough voltage at the output of the ballast to heat the cathodes of the lamp, but not enough to strike the lamp. After a half second the preheat circuit releases control of the Frequency Shift Circuit 215.

The Feedback Loop Circuit 209 senses the arc current in the lamp using R116 and compares it to the Phase to DC Converter 203 output voltage. If there is a difference between the two signals the circuit modifies the duty cycle of the half-bridge inverter (Q6 and Q7) to reduce the difference. This changes the voltage into the resonant tank circuit, consisting of the resonant inductor L2 and resonant capacitors C17, C18, and C19, and thus keeps the arc current constant.

If not properly controlled, a compact fluorescent lamp can have a non-benign failure at the end of its life. The End of Life Protection Circuit 211 measures the output voltage and filters it to find if there is any DC voltage across the lamp. If there is too much DC, signaling end of lamp life, the circuit will reduce the light level. This reduces the power in the lamp and allows it to have a benign end of life.

A ballast needs to be able to provide high output voltages to strike and operate a compact fluorescent lamp, but not be so high as to damage the ballast. The Over Voltage Protection Circuit 213 detects the output voltage of the ballast and ensures that it never becomes high enough to damage the ballast or become unsafe.

The Frequency Shift Circuit 215 modifies the frequency of operation of the ballast. When the duty cycle of the phase control input to the ballast is high, the frequency is held at 48 kHz. As the duty cycle of the phase control input is reduced, the Frequency Shift Circuit 215 raises the oscillator frequency to improve the output impedance of the ballast.

Figure 4:
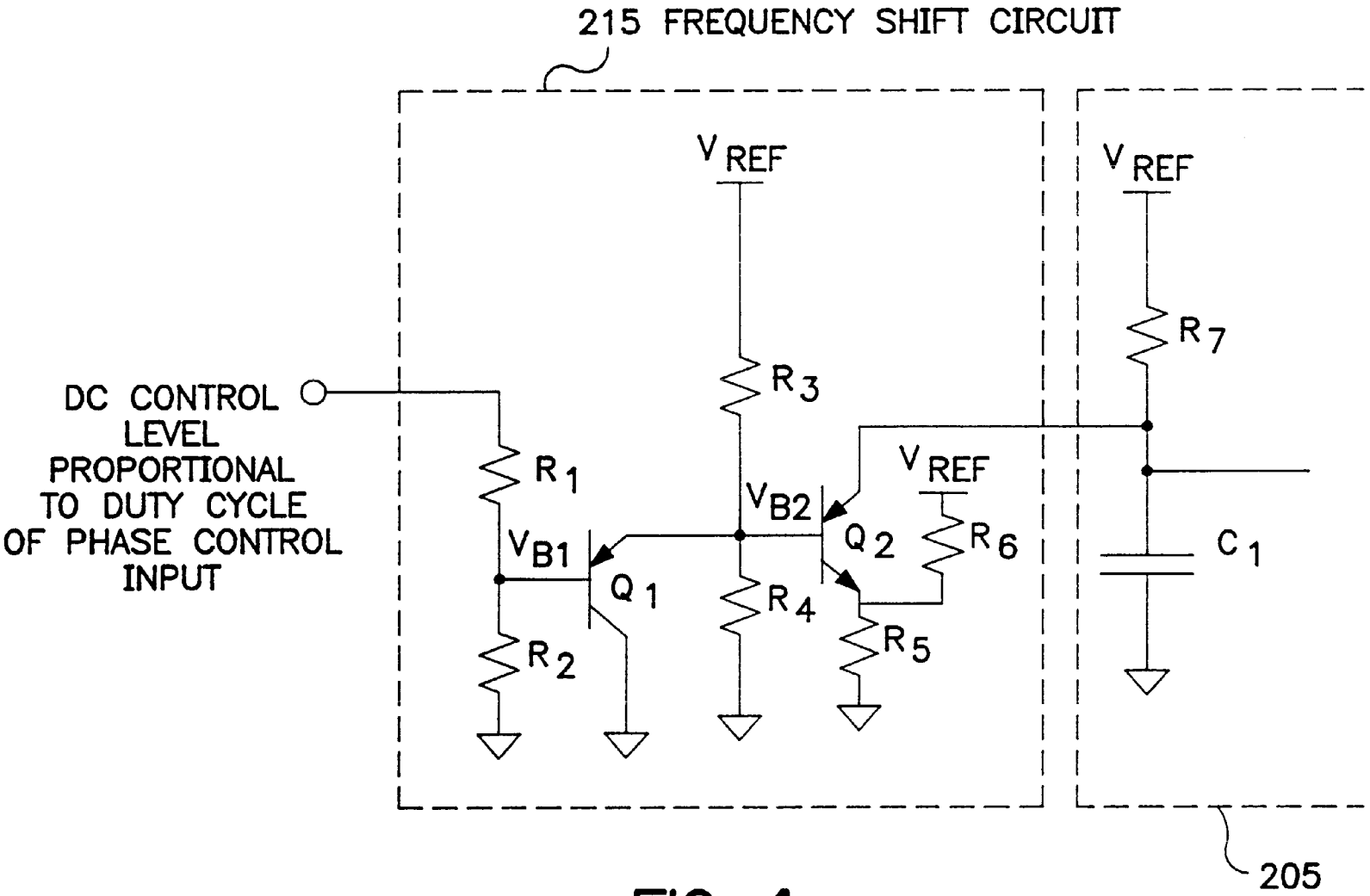
FIG. 4 is a schematic diagram of a frequency shift circuit used in the ballast according to the present invention.

FIG. 4 shows a schematic diagram of the Frequency Shift Circuit 215. The nominal oscillating frequency is set by C1 and R7. The Frequency Shift Circuit 215 changes the frequency of the oscillator by sinking some of the current that would go to the oscillator capacitor (C1). Since less current flows into the capacitor C1, it takes longer to charge, thus lowering the frequency of oscillation.

$V_{ref}$=5.0V oscillator frequency=48 kHz to 85 kHz

DC level input=2.2V to 0.7V

The resistor divider R5, R6, sets a voltage of 0.5V at the emitter of transistor Q2. This holds transistor Q2 in cutoff until $V_{B2}$ rises above 0.5V+0.7V=1.2V. This keeps transistor Q2 from sinking current from the oscillator when the dc level input is below 1 Vdc (1 Vdc corresponds to approximately 20% light output). Since transistor Q2 is not sinking any current the oscillator stays at 85 kHz. As the DC level is increased, the resistor divider R1, R2 raises $V_{B1}$. Transistor Q1 then acts as an emitter follower so the voltage at $V_{B2}$ follows $V_{B1}$. As this voltage rises, the amount of current that transistor Q2 sinks also rises, and the oscillator frequency drops. The resistor divider R3, R4 is set to stop $V_{B2}$ at the voltage necessary to bring the frequency to 48 kHz. Transistor Q1 is then in cutoff SO $V_{B2}$ cannot rise further and the oscillator remains at 48 kHz.

Figure 5:
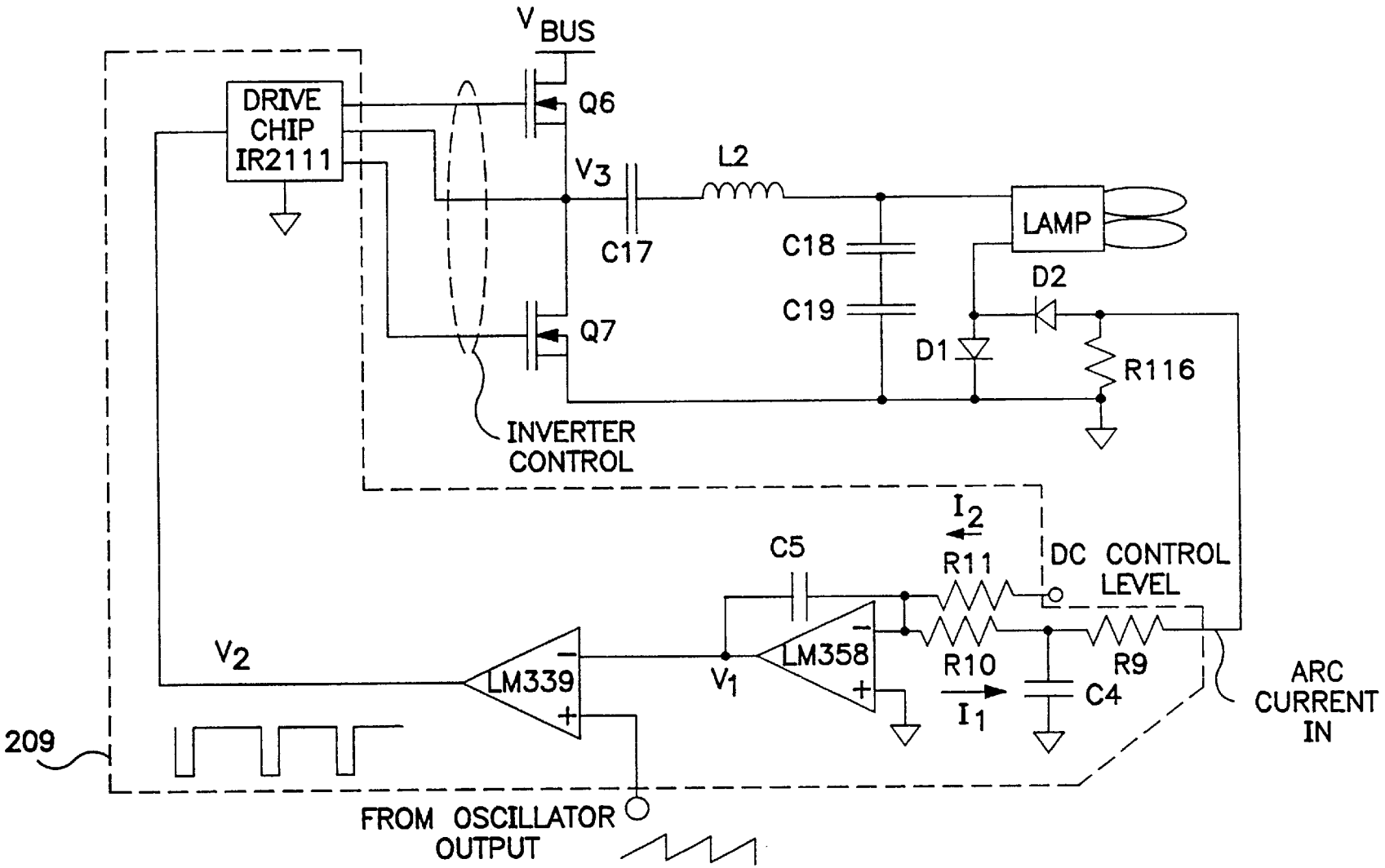
FIG. 5 is a schematic diagram of a feedback loop circuit used in the ballast according to the present invention.

FIG. 5 shows a schematic diagram of the Feedback Loop Circuit 209. The Feedback Loop Circuit 209 measures the current through the lamp and compares it to a reference current proportional to the dc level from the Phase to DC Converter 203. It then adjusts the duty cycle of the half-bridge inverter controllably conductive devices Q6 and Q7 to keep the lamp current constant and proportional to the reference current.

Arc current flowing through the lamp will flow through resistor R116 and diodes D1 and D2. The diodes rectify the current so that a negative voltage is produced across resistor R116. This voltage is filtered by resistor R9 and capacitor C4 and produces a current, $I_1$, in resistor R10. The dc control level from the Phase to DC Converter 203 causes a current, $I_2$, to flow in R11. The operational amplifier which is preferably a LM358, and capacitor C5 integrate the difference between $I_1$ and $I_2$. If $I_1$ is greater than $I_2$, $V_1$ will start to rise; if it is less, then $V_1$ will fall. $V_1$ is then compared to the oscillator voltage by the comparator, which is preferably a LM339. This creates a voltage waveform at $V_2$ which is a duty cycle modulated square wave. If $V_2$ is high, the driver circuit, preferably a IR2111, turns on the top switch Q6 of the inverter. If $V_2$ is low, drive circuit turns on the bottom switch Q7 of the inverter. By varying the duty cycle from 0% to 50%, the voltage going into the resonant circuit of inductor L2, and capacitors C17, C18, and C19 can be controlled, and thus the voltage across the lamp can be controlled. Capacitor C17 blocks DC from appearing across inductor L2, so inductor L2 does not saturate. If the arc current is too low, in other words $I_2>I_1$, $V_1$ will decrease, and the duty cycle at $V_2$ will increase. The voltage at $V_3$ will increase, and so will the voltage across the lamp, thus raising the arc current back to the desired level.

Figure 6:
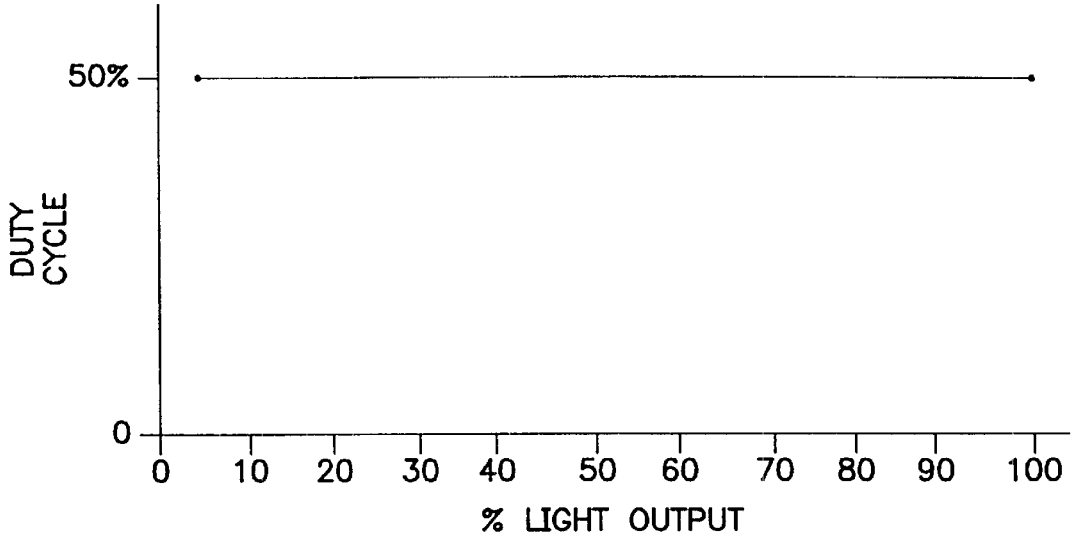
FIG. 6 PRIOR ART
FIG. 6 shows a plot of duty cycle versus percentage of light output for one type of ballast according to the prior art.

FIG. 6 shows a plot of duty cycle versus percentage of light output for an Advance Transformer ballast model REZ1T32. The duty cycle remains constant throughout the entire dimming range. This product has a low end light output of approximately 5% of the maximum light output.

Figure 7:
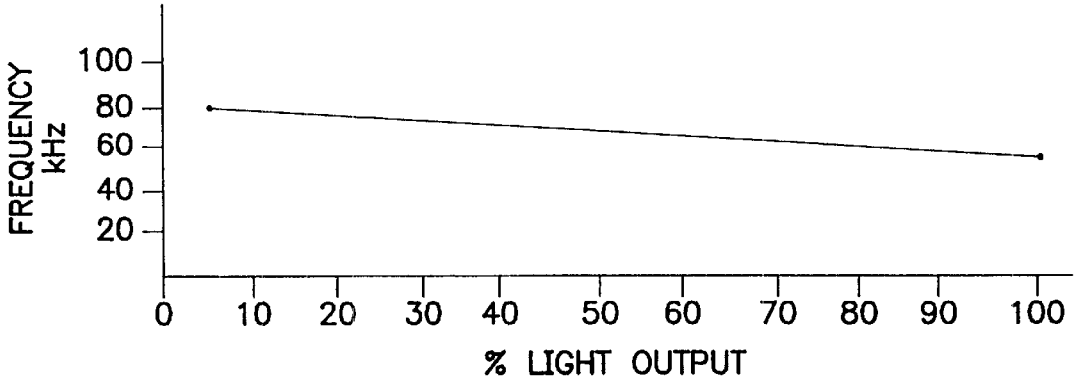
FIG. 7 PRIOR ART
FIG. 7 shows a plot of Frequency versus percentage of light output for the same prior art ballast.

FIG. 7 shows a plot of frequency versus percentage of light output for the Advance Transformer ballast. The frequency decreases from about 81 kHz at low end light output to about 48.5 kHz at high end light output. From this figure, it can be seen that the design of a suitable EMI filter is greatly complicated because at high light levels, between 80% and 100%, the frequency varies. The frequency varies substantially linearly from approximately 48.5 kHz at 100% light output to approximately 81 kHz at 5% light output.

Figure 8:
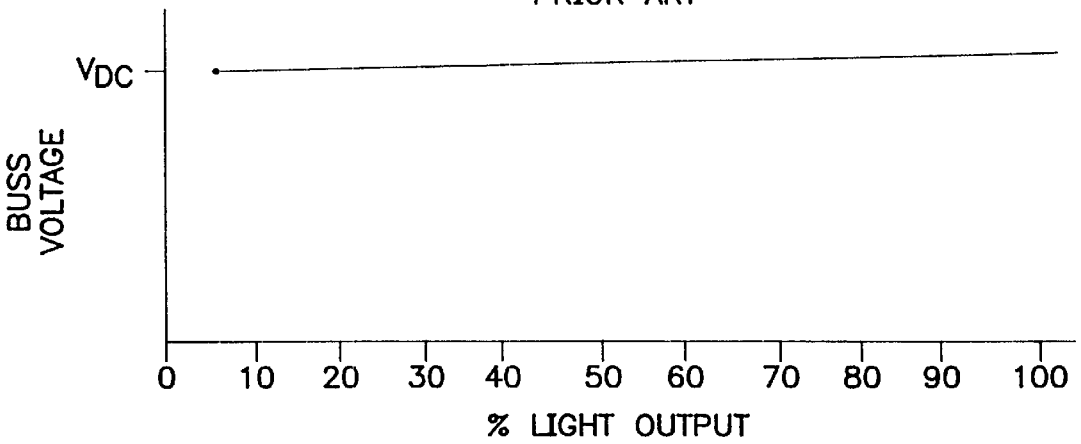
FIG. 8 PRIOR ART
FIG. 8 shows a plot of bus voltage versus percentage of light output for the same prior art ballast.

FIG. 8 shows a plot of bus voltage versus percentage of light output for the Advance Transformer ballast. Bus voltage is the voltage across the inverter. The bus voltage remains constant throughout the dimming range.

Figure 9:
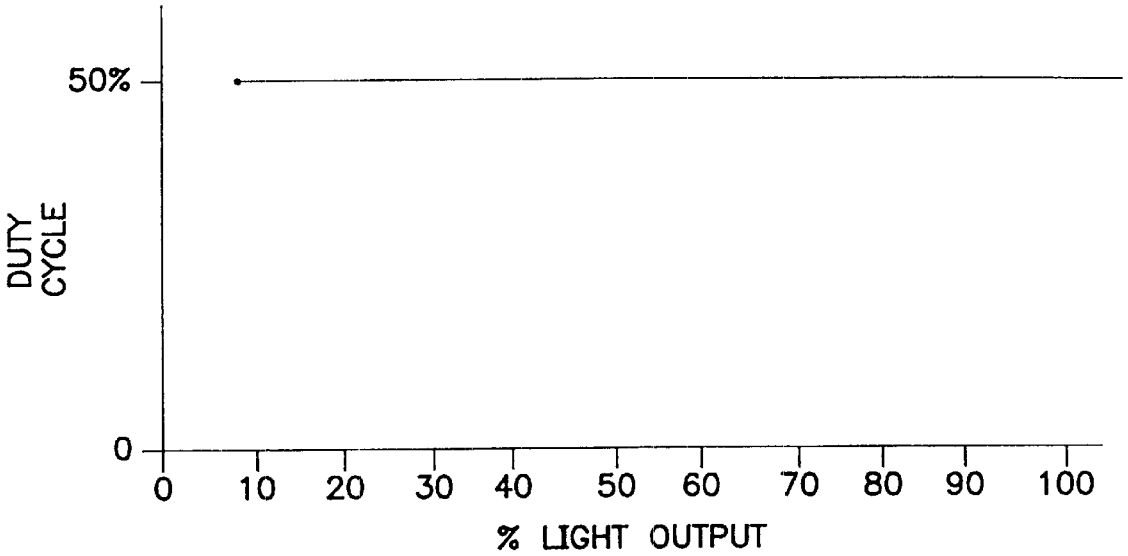
FIG. 9 PRIOR ART
FIG. 9 shows a plot of duty cycle versus percentage of light output for another type of ballast according to the prior art.

FIG. 9 shows a plot of duty cycle versus percentage of light output for an Energy Savings Inc. ballast model ES-Z-T8-32-120-A-Dim-E. The duty cycle remains constant through out the entire dimming range. This product has a low end light output of approximately 10% of the maximum light output.

Figure 10:
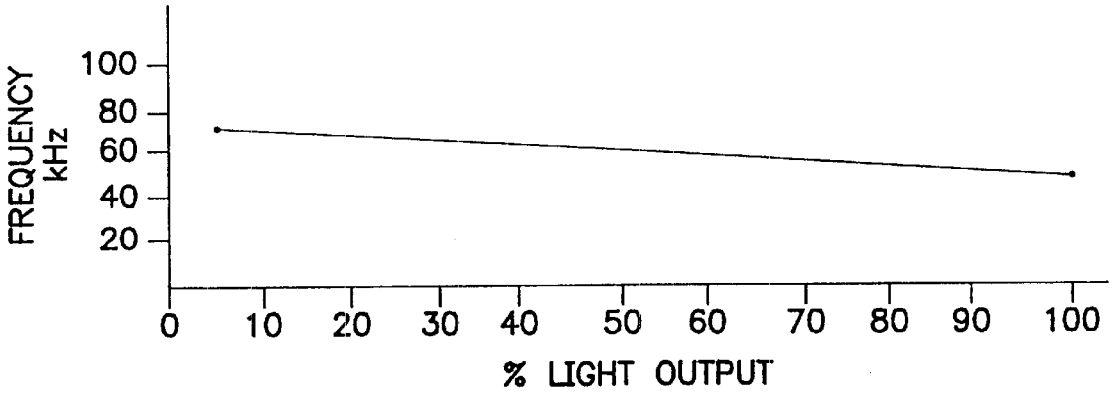
FIG. 10 PRIOR ART
FIG. 10 shows a plot of Frequency versus percentage of light output for the other prior art ballast.

FIG. 10 shows a plot of frequency versus percentage of light output for the Energy Savings Inc. ballast. The frequency decreases from about 66.4 kHz at low end light output to about 43 kHz at high end light output. From this figure, it can be seen that the design of a suitable EMI filter is greatly complicated because at high light levels, between 80% and 100%, the frequency varies. The frequency varies substantially linearly from approximately 43 kHz at 100% light output to approximately 66.43 kHz at 10% light output.

Figure 11:
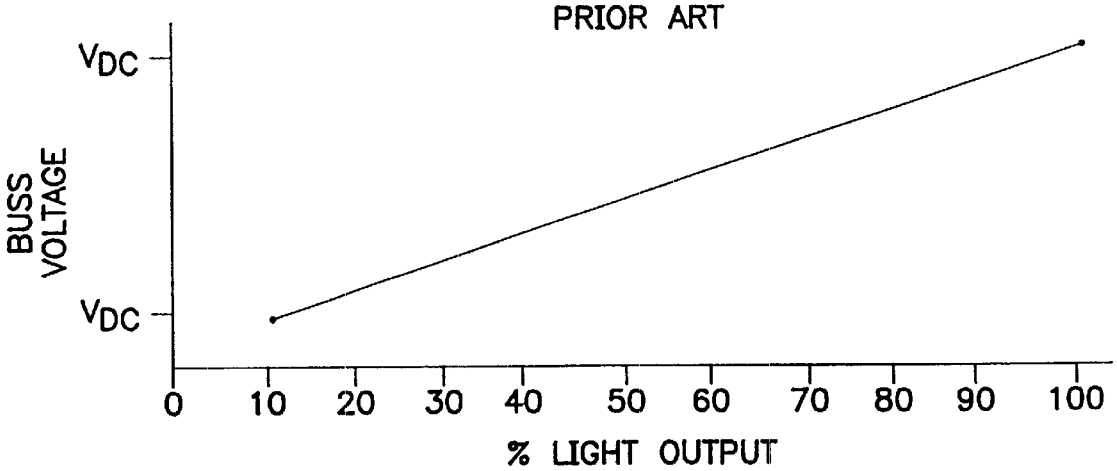
FIG. 11 PRIOR ART
FIG. 11 shows a plot of bus voltage versus percentage of light output for the other prior art ballast.

FIG. 11 shows a plot of bus voltage versus percentage of light output for the Energy Savings Inc. ballast. The bus voltage increases from low end light output to high end light output.

Figure 12:
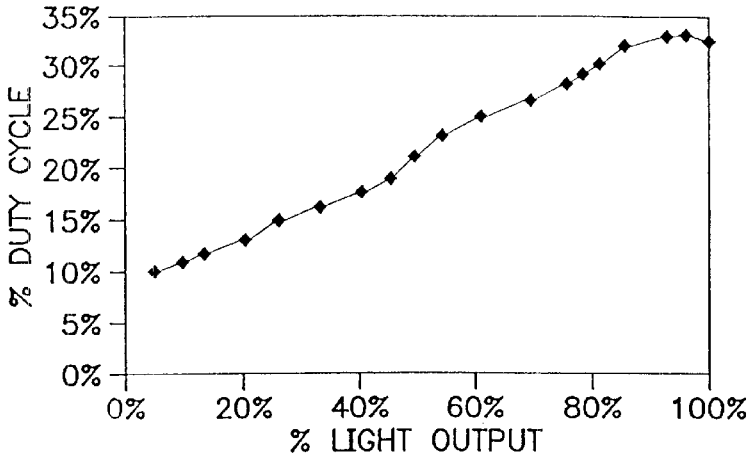
FIG. 12 shows a plot of duty cycle versus percentage of light output for the ballast of the present invention.

FIG. 12 shows a plot of duty cycle versus percentage of light output for the ballast of the present invention. The duty cycle increases from low end light output to high end light output. This ballast provides a low end light output of approximately 5% of the maximum light output. It can be seen from FIG. 12 that the duty cycle of the preferred embodiment of the present invention has a maximum value of approximately 35%, at high end light output. This value was chosen to allow room to adjust the duty cycle without increasing the duty cycle above 50%. The ballast attempts to maintain a constant arc current by adjusting the duty cycle. This is done to compensate for variations in lamp characteristics from one manufacturer to another and in case the incoming line voltage sags. The duty cycle of the preferred embodiment has a minimum duty cycle of approximately 10%.

Figure 13:
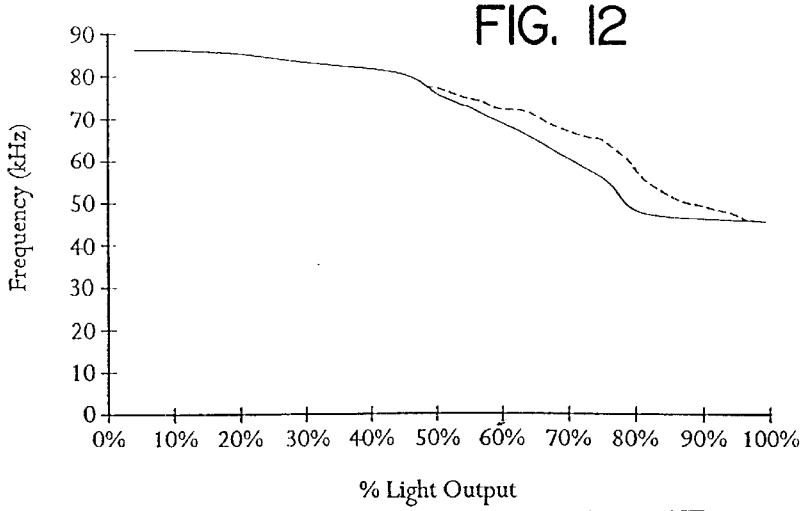
FIG. 13 shows a plot of Frequency versus percentage of light output for the ballast of the present invention.

FIG. 13 shows a plot of frequency versus percentage of light output for the ballast of the present invention. In the present invention the output lamp frequency is constant from 100% light to approximately 80% light. The value of the frequency is preferably 48 kHz. The frequency changes approximately linearly from approximately 80% light output to approximately 20% light output. The frequency then remains constant from approximately 20% light output to the low end of approximately 5% light output. The value of the frequency is preferably 85 Khz at low end light output. The value of 85 kHz was chosen such that the ballast is at the resonant frequency of the parallel loaded resonant circuit whereby the ballast has the maximum output impedance to operate the lamps. The point 20% was chosen so that when the lamp reaches its point of maximum negative incremental impedance, shown as point 101 in FIG. 15, the ballast has sufficient output impedance to properly operate the lamp to low end output. From FIG. 13, it can be seen that the design of a suitable EMI filter is greatly simplified because at high end light levels, between 80% and 100%, the frequency remains constant.

It can also be seen from FIG. 13 that, at light output levels above approximately 45%, the frequency can be within a range illustrated by the upper (dashed) curve and the lower (solid) curve. The exact frequency may vary slightly depending on circuit component values and tolerancces, and such variations are within the scope of the present invention.

Figure 14:
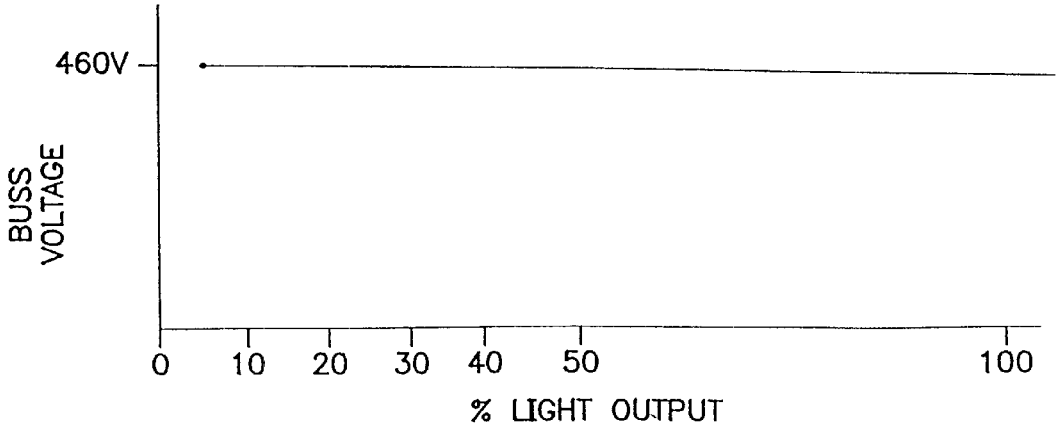
FIG. 14 shows a plot of bus voltage versus percentage of light output for the ballast of the present invention.

FIG. 14 shows a plot of bus voltage versus percentage of light output for the ballast of the present invention. The bus voltage remains constant throughout the dimming range.

Figure 15:
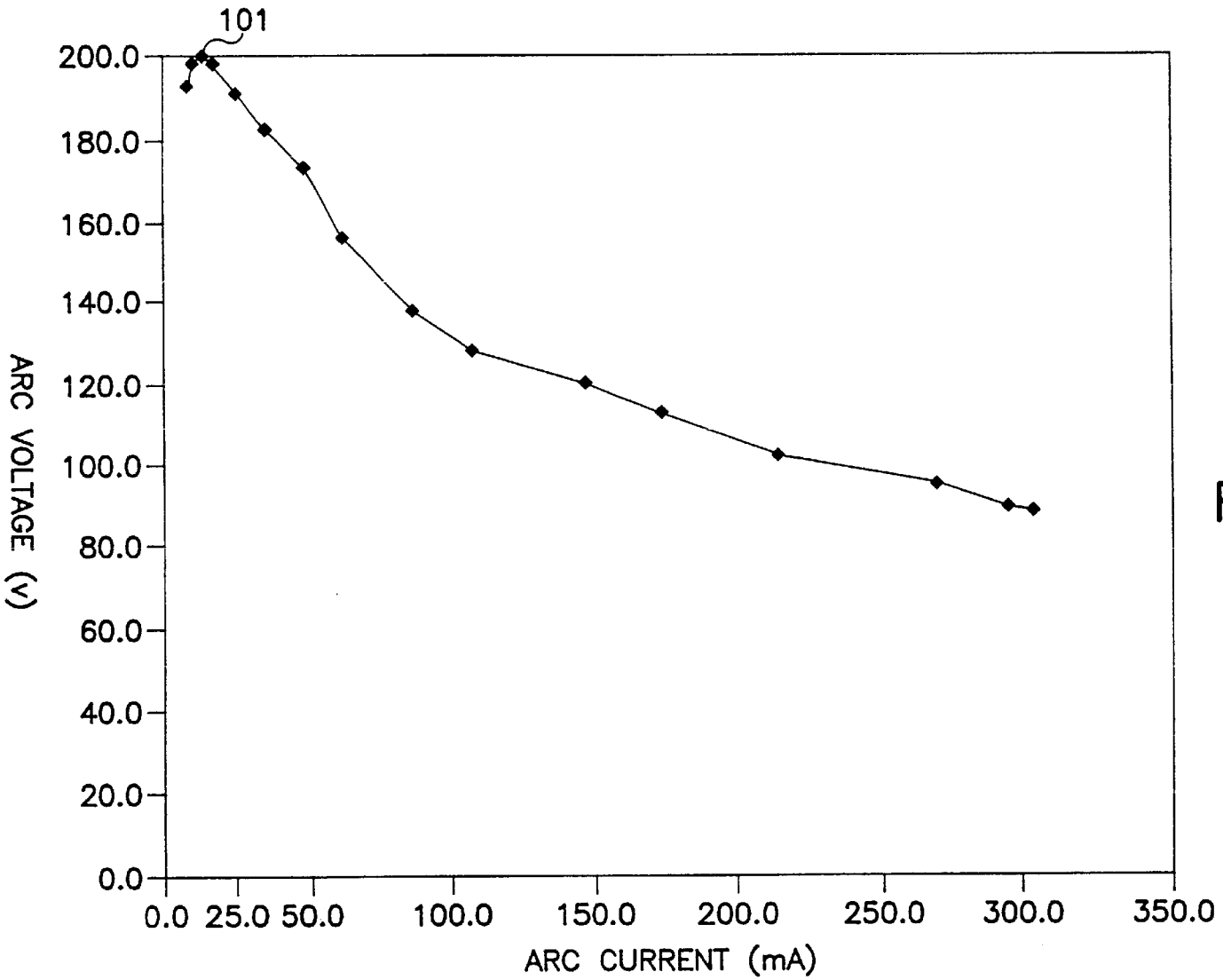
FIG. 15 shows a plot of arc voltage versus arc current for a 32 watt Osram/Sylvania compact fluorescent lamp.

FIG. 15 shows a plot of arc voltage versus arc current for a 32 watt Osram/Sylvania compact fluorescent lamp. The plot for this lamp shows the point of maximum lamp impedance as point 101. This corresponds to an arc current of approximately 25 mA. Other lamps would have similar characteristics, but different values.

Figure 16:
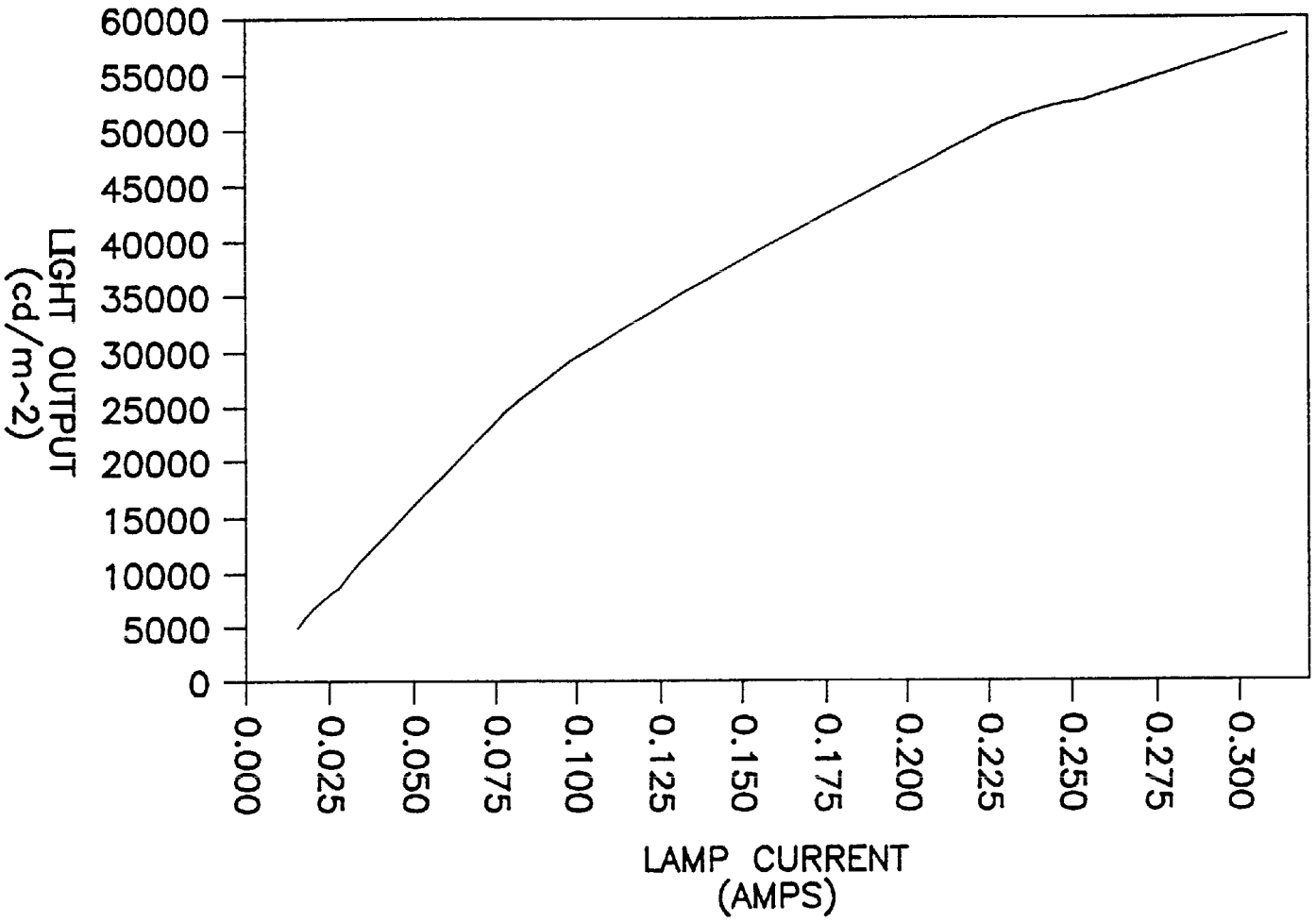
FIG. 16 shows a plot of light output versus arc current for a 32 watt Osram/Sylvania compact fluorescent lamp.

FIG. 16 shows a plot of light output versus arc current. At the point of maximum lamp impedance (25 mA) the light output is approximately 7000 cd/M$^2$, which is approximately 12% of maximum light output (7000/60,0000 cd/m$^2$) for the lamp shown. The value of light output at which the frequency returns to a constant value was chosen to be 20% (as shown in FIG. 13) to ensure that the frequency has reached the value that provides maximum output impedance before the lamp reaches the point ofmaximum negative incremental impedance. The percent light output at which the lamp reaches maximum impedance varies from manufacturer to manufacturer, and sometimes from lamp to lamp.

The present invention may be embodied in other specific forms without departing from the spirit or essential attributes thereof and, accordingly, reference should be made to the appended claims, rather than to the foregoing specifcation, as indicating the scope of the invention.

What is claimed is:

1. An electronic dimming ballast for fluorescent lamps, comprising a circuit comprising at least one controllably conductive device for supplying a selected arc current to a fluorescent lamp to achieve a desired light output level from the lamp, a first circuit responsive to a dimming signal containing information representative of the desired light output level and generating an ac oscillator signal having a frequency determined by the dimming signal, and a second circuit responsive to the dimming signal for creating a duty cycle of operation for the at least one controllably conductive device at the frequency of the ac oscillator signal, the duty cycle being determined by the dimming signal, whereby the frequency and the duty cycle of operation of the at least one controllably conductive device arc independently determinable over a range of desired light output levels of the lamp.

2. An electronic dimming ballast according to claim 1, wherein the first circuit and the second circuit have at least one circuit element in common.

3. An electronic dimming ballast for fluorescent lamps, comprising an inverter circuit comprising at least one controllably conductive device for supplying a selected arc current to a fluorescent lamp to achieve a desired light output level from the lamp ranging from a minimum light output to a maximum light output, a first circuit for receiving a dimming signal containing information representative of a desired light level and generating a control signal representative of the desired light level, a second circuit responsive to the control signal for generating an ac oscillator signal having a frequency determined by the control signal, and a third circuit responsive to the control signal for creating a duty cycle of operation for the at least one controllably conductive device at the frequency of the ac oscillator signal, the duty cycle being determined by the control signal, whereby the frequency and the duty cycle of operation of the at least one controllably conductive device arc independently determinable over the range of desired light levels from the minimum light output up to the maximum light output.

4. An electronic dimming ballast for fluorescent lamps according to claim 3, wherein the duty cycle of operation of the at least one controllably conductive device is variable over the range of desired light levels from the minimum light output up to the maximum light output and the frequency of operation of the at least one controllably conductive device is variable over a range of desired light levels from the minimum light output up to a light output intermediate the minimum light output and the maximum light output and is substantially constant over a range of desired light levels from the intermediate light output up to the maximum light output.

5. An electronic dimming ballast for fluorescent lamps according to claim 3, wherein the duty cycle of operation of the at least one controllably conductive device is variable over the range of desired light levels from the minimun light output up to the maximum light output and the frequency of operation of the at least one controllably conductive device is substantially constant over a range of desired light levels from the minimum light output up to a light output intermediate the minimum light output and the maximum light output and is variable over a range of desired light levels above the intermediate light output.

6. An electronic dimming ballast for fluorescent lamps according to claim 3, wherein the duty cycle of operation of the at least one controllably conductive device is variable over the range of desired light levels from the minimum light output up to the maximum light output and the frequency of operation of the at least one controllably conductive device is substantially constant over a range of desired light levels from the minimum light output up to a first light output intermediate the minimum light output and the maximum light output, is variable over a range of desired light levels from the first light output up to a second light output intermediate the first light output and the maximum light output, and is substantially constant over a range of desired light levels from the second light output up to the maximum light output.

7. An electronic dimming ballast according to claim 3, wherein the second circuit and the third circuit have at least one circuit element in common.

8. An electronic dimming ballast for fluorescent lamps, comprising an inverter circuit comprising at least one controllably conductive device for supplying a selected arc current to a fluorescent lamp to achieve a desired light output level from the lamp ranging from a minimum light output to a maximum light output, a first circuit for receiving a dimming signal having a variable duty cycle and generating a control signal representative of the duty cycle of the dimming signal, a second circuit responsive to the control signal for generating an ac oscillator signal having a frequency determined by the control signal, and a third circuit responsive to the control signal for creating a duty cycle of operation for the at least one controllably conductive device at the frequency of the ac oscillator signal, the duty cycle being determined by the control signal, whereby the frequency and the duty cycle of operation of the at least one controllably conductive device arc independently determinable over the range of desired light levels from the minimum light output up to the maximum light output.

9. An electronic dimming ballast for fluorescent lamps according to claim 8, wherein the duty cycle of operation of the at least one controllably conductive device is variable over the range of dimming signal duty cycles corresponding to the minimum light output up to the maximum light output and the frequency of operation of the at least one controllably conductive device is variable over a range of dimming signal duty cycles corresponding to the minimum light output up to a light output intermediate the minimum light output and the maximum light output and is substantially constant over a range of dimming signal duty cycles corresponding to the intermediate light output up to the maximum light output.

10. An electronic dimming ballast for fluorescent lamps according to claim 8, wherein the duty cycle of operation of the at least one controllably conductive device is variable over the range of dimming signal duty cycles corresponding to the minimum light output up to the maximum light output and the frequency of operation of the at least one controllably conductive device is substantially constant over a range of dimming signal duty cycles corresponding to the minimum light output up to a light output intermediate the minimum light output and the maximum light output and is variable over a range of dimming signal duty cycles above that corresponding to the intermediate light output.

11. An electronic dimming ballast for fluorescent lamps according to claim 8, wherein the duty cycle of operation of the at least one controllably conductive device is variable over the range of dimming signal duty cycles corresponding to the minimum light output up to the maximum light output and the frequency of operation of the at least one controllably conductive device is substantially constant over a range of dimming signal duty cycles corresponding to the minimum light output up to a first light output intermediate the minimum light output and the maximum light output, is variable over a range of dimming signal duty cycles corresponding to the first light output up to a second light output intermediate the first light output and the maximum light output, and is substantially constant over a range of dimming signal duty cycles corresponding to the second light output up to the maximum light output.

12. An electronic dimming ballast according to claim 8, wherein the second circuit and the third circuit have at least one circuit element in common.

13. A dimming circuit for selectably controlling the light output of a fluorescent lamp, comprising a dimming control circuit for generating a dimming signal representing a specified light output of the lamp in a range from a minimum light output of the lamp to a maximum light output of the lamp, an inverter circuit comprising at least one controllably conductive device for supplying a selected arc current to the fluorescent lamp to achieve a desired light output level from the fluorscent lamp ranging from a minimum light output to a maximum light output, a first circuit for receiving said dimming signal and generating a control signal representative of the specified light output, a second circuit responsive to the control signal for generating an ac oscillator signal having a frequency determined by the control signal, and a third circuit responsive to the control signal for creating a duty cycle of operation for the at least one controllably conductive device at the frequency of the ac oscillator signal, the duty cycle being determined by the control signal, whereby the frequency and the duty cycle of operation of the at least one controllably conductive device are independently determinable for specified light outputs of the lamp from the minimum light output up to the maximum light output.

14. An electronic dimming ballast according to claim 13, wherein the second circuit and the third circuit have at least one circuit element in common.

15. A dimming circuit for selectably controlling the light output of a fluorescent lamp according to claim 13, wherein the duty cycle of operation of the at least one controllably conductive device is variable for specified light outputs from the minimum light output up to the maximum light output and the frequency of operation of the at least one controllably conductive device is variable for specified light outputs from the minimum light output up to a light output intermediate the minimum light output and the maximum light output and is substantially constant for specified light outputs from the intermediate light output up to the maximum light output.

16. A dimming circuit for selectably controlling the light output of a fluorescent lamp according to claim 13, wherein the duty cycle of operation of the at least one controllably conductive device is variable for specified light outputs from the minimum light output up to the maximum light output and the frequency of operation of the at least one controllably conductive device is substantially constant for specified light outputs from the minimum light output up to a light output intermediate the minimum light output and the maximum light output and is variable for specified light outputs in a range above the intermediate light output.

17. A dimming circuit for selectably controlling the light output of a fluorescent lamp according to claim 13, wherein the duty cycle of operation of the at least one controllably conductive device is variable for specified light outputs from the minimum light output up to the maximum light output and the frequency of operation of the at least one controllably conductive device is substantially constant for specified light outputs from the minimum light output up to a first light output intermediate the minimum light output and the maximum light output, is variable for specified light outputs from the first light output up to a second light output intermediate the first light output and the maximum light output, and is substantially constant for specified light outputs from the second light output up to the maximum light output.

18. A dimming circuit for selectably controlling the light output of a fluorescent lamp, comprising a dimming control circuit for generating a variable duty cycle dimming signal, the duty cycle being variable over a range of duty cycles from a minimum duty cycle corresponding to a minimum light output of the lamp to a maximum duty cycle corresponding to a maximum light output of the lamp, an inverter circuit comprising at least one controllably conductive device for supplying a selected arc current to the fluorescent lamp to achieve a desired light output from the fluorescent lamp ranging from a minimum light output to a maximum light output, a first circuit for receiving said variable duty cycle dimming signal and generating a control signal representative of the duty cycle of the dimming signal, a second circuit responsive to the control signal for generating an ac oscillator signal having a frequency determined by the control signal, and a third circuit responsive to the control signal for creating a duty cycle of operation for the at least one controllably conductive device at the frequency of the ac oscillator signal, the duty cycle of operation being determined by the control signal, whereby the frequency and the duty cycle of operation of the at least one controllably conductive device are independently determinable over the range of lamp light outputs from the minimum light output up to the maximum light output.

19. A dimming circuit for selectably controlling the light output of a fluorescent lamp according to claim 18, wherein the duty cycle of operation of the at least one controllably conductive device is variable over the range of dimming signal duty cycles corresponding to the minimum light output up to the maximum light output and the frequency of operation of the at least one controllably conductive device is variable over a range of dimming signal duty cycles corresponding to the minimum light output up to a light output intermediate the minimum light output and the maximum light output and is substantially constant over a range of dimming signal duty cycles corresponding to the intermediate light output up to the maximum light output.

20. A dimming circuit for selectably controlling the light output of a fluorescent lamp according to claim 18, wherein the duty cycle of operation of the at least one controllably conductive device is variable over the range of dimming signal duty cycles corresponding to the minimum light output up to the maximum light output and the frequency of operation of the at least one controllably conductive device is substantially constant over a range of dimming signal duty cycles corresponding to the minimum light output up to a light output intermediate the minimum light output and the maximum light output and is variable over a range of dimming signal duty cycles corresponding to light output above the intermediate light output.

21. An electronic dimming ballast according to claim 18, wherein the second circuit and the third circuit have at least one circuit element in common.

22. A dimming circuit for selectably controlling the light output of a fluorescent lamp according to claim 18, wherein the duty cycle of operation of the at least one controllably conductive device is variable over the range of dimming signal duty cycles corresponding to the minimum light output up to the maximum light output and the frequency of operation of the at least one controllably conductive device is substantially constant over a range of dimming signal duty cycles corresponding to the minimum light output up to a first light output intermediate the minimum light output and the maximum light output, is variable over a range of dimming signal duty cycles corresponding to the first light output up to a second light output intermediate the first light output and the maximum light output, and is substantially constant over a range of dimming signal duty cycles corresponding to the second light output up to the maximum light output.

23. A method of selectably controlling the light output of a fluorescent lamp using an inverter circuit having at least one controllably conductive device for supplying a selected arc current to the fluorescent lamp to achieve a desired light output from the fluorescent lamp ranging from a minimum light output to a maximum light output, comprising the steps of generating a dimming signal variable from a state corresponding to a minimum light output of the lamp to a state corresponding to a maximum light output of the lamp, generating a control signal representative of the dimming signal, generating an ac oscillator signal having a frequency determined by the control signal, and generating a duty cycle of operation for the at least one controllably conductive device at the frequency of the ac oscillator signal, the duty cycle being determined by the control signal, whereby the frequency and the duty cycle of operation of the at least one controllably conductive device are independently determinable over the range of dimming signals variable from the state corresponding to the minimum light output up to the maximum light output.

24. A method of selectably controlling the light output of a fluorescent lamp according to claim 23, wherein the step of generating the ac oscillator signal comprises varying the ac oscillator signal frequency for states of the dimming signal corresponding to the minimum light output up to a light output intermediate the minimum light output and the maximum light output and maintaining the frequency substantially constant for states of the dimming signal corresponding to the intermediate light output up to the maximum light output.

25. A method of selectably controlling the light output of a fluorescent lamp according to claim 23, wherein the step of generating the ac oscillator signal comprises maintaining the ac oscillator signal frequency substantially constant for states of the dimming signal corresponding to the minimum light output up to a light output intermediate the minimum light output and the maximum light output and varying the frequency for states of the dimming signal corresponding to a range of light outputs above the intermediate light output.

26. A method of selectably controlling the light output of a fluorescent lamp according to claim 23, wherein the step of generating the ac oscillator signal comprises maintaining the ac oscillator signal frequency substantially constant for states of the dimming signal corresponding to the minimum light output up to a first light output intermediate the minimum light output and the maximum light output, varying the frequency for states of the dimming signal corresponding to the first light output up to a second light output intermediate the first light output and the maximum light output, and maintaining the frequency substantially constant for states of the dimming signal corresponding to the second light output up to the maximum light output.

27. A method of selectably controlling the light output of a fluorescent lamp using an inverter circuit having at least one controllably conductive device for supplying a selected arc current to the fluorescent lamp to achieve a desired light output from the lamp ranging from a minimum light output to a maximum light output, comprising the steps of generating a variable duty cycle dimming signal, the duty cycle being variable over a range of duty cycles from a minimum duty cycle corresponding to a minimum light output of the lamp to a maximum duty cycle corresponding to a maximum light output of the lamp, generating a control signal representative of the duty cycle of the dimming signal, generating an ac oscillator signal having a frequency determined by the control signal, and generating a duty cycle of operation for the at least one controllably conductive device at the frequency of the ac oscillator signal, the duty cycle being determined by the control signal, whereby the frequency and the duty cycle of operation of the at least one controllably conductive device are independently determinable over the range of lamp light outputs from the minimum light output up to the maximum light output.

28. A method of selectably controlling the light output of a fluorescent lamp according to claim 27, wherein the step of generating the ac oscillator signal comprises varying the ac oscillator signal frequency over a range of dimming signal duty cycles corresponding to the minimum light output up to a light output intermediate the minimum light output and the maximum light output and maintaining the frequency substantially constant over a range of dimming signal duty cycles corresponding to the intermediate light output up to the maximum light output.

29. A method of selectably controlling the light output of a fluorescent lamp according to claim 27, wherein the step of generating the ac oscillator signal comprises maintaining the ac oscillator signal frequency substantially constant over a range of dimming signal duty cycles corresponding to the minimum light output up to a light output intermediate the minimum light output and the maximum light output and varying the frequency over a range of dimming signal duty cycles above the intermediate light output.

30. A method of selectably controlling the light output of a fluorescent lamp according to claim 27, wherein the step of generating the ac oscillator signal comprises maintaining the ac oscillator signal frequency substantially constant over a range of dimming signal duty cycles corresponding to the minimum light output up to a first light output intermediate the minimum light output and the maximum light output, varying the frequency over a range of dimming signal duty cycles corresponding to the first light output up to a second light output intermediate the first light output and the maximum light output, and maintaining the frequency substantially constant over a range of dimming signal duty cycles corresponding to the second light output up to the maximum light output.

31. An electronic dimming ballast for gas discharge lamps, comprising:

a controllably conductive device adapted to supply a selected arc current to a gas discharge lamp to achieve a desired light output level from the lamp;

a first circuit to determine the frequency of operation of said controllably conductive device in response to a dimming signal representative of the desired light output level; and a second circuit to determine the duty cycle of operation of said controllably conductive device in response to said dimming signal.

* * * * *